US007942542B1

(12) United States Patent
Dunn

(10) Patent No.: US 7,942,542 B1
(45) Date of Patent: May 17, 2011

(54) BACK LIGHTED REPLACEABLE IMAGE SHEET DISPLAY APPARATUS

(76) Inventor: Gary Dunn, Rogers, AR (US)

( * ) Notice: Subject to any disclaimer, the term of this patent is extended or adjusted under 35 U.S.C. 154(b) by 136 days.

(21) Appl. No.: 12/456,700

(22) Filed: Jun. 19, 2009

Related U.S. Application Data

(60) Provisional application No. 61/132,674, filed on Jun. 20, 2008.

(51) Int. Cl.
*G09F 13/04* (2006.01)

(52) U.S. Cl. ..... 362/97.3; 362/604; 362/606; 362/632; 40/546

(58) Field of Classification Search ..... 362/600, 362/601, 605–606, 609, 632, 634, 97.1, 97.3, 362/97.4; 40/546, 564
See application file for complete search history.

(56) References Cited

U.S. PATENT DOCUMENTS

| | | | | |
|---|---|---|---|---|
| 3,106,314 | A | 10/1963 | Spears | 221/35 |
| 4,714,983 | A * | 12/1987 | Lang | 362/27 |
| 5,230,172 | A * | 7/1993 | Hsu | 40/732 |
| 5,265,357 | A * | 11/1993 | Yu | 40/714 |
| 5,377,084 | A | 12/1994 | Kojima et al. | 362/31 |
| 5,730,518 | A | 3/1998 | Kashima et al. | 362/31 |
| 5,842,297 | A | 12/1998 | Tung | 40/546 |
| 5,943,801 | A * | 8/1999 | Wilkinson | 40/564 |
| 6,367,392 | B2 | 4/2002 | Moore | 108/90 |
| 6,447,136 | B1 | 9/2002 | Liu et al. | 362/31 |
| 6,530,164 | B2 | 3/2003 | Gai | 40/546 |
| 6,539,656 | B2 | 4/2003 | Maas et al. | 40/546 |
| 6,561,672 | B2 | 5/2003 | Lessard | 362/234 |
| 6,691,443 | B1 | 2/2004 | Slayden | 40/546 |
| 6,920,711 | B2 * | 7/2005 | Miller et al. | 40/715 |
| 6,926,420 | B2 | 8/2005 | Sung | 362/31 |
| 6,968,959 | B1 | 11/2005 | Garvin | 211/50 |
| 7,024,809 | B1 | 4/2006 | Poma | 40/546 |
| 7,026,916 | B2 | 4/2006 | Alexander | 340/286.09 |
| 7,048,398 | B2 | 5/2006 | Bahramian | 362/31 |
| 7,063,449 | B2 | 6/2006 | Ward | 362/616 |
| 7,131,764 | B2 | 11/2006 | Hsu et al. | 362/623 |
| 7,186,015 | B2 | 3/2007 | Kimmet et al. | 362/630 |
| 7,226,200 | B2 | 6/2007 | Tsai | 362/616 |
| 7,665,879 | B2 * | 2/2010 | Hsieh | 362/633 |
| 7,766,536 | B2 * | 8/2010 | Peifer et al. | 362/633 |
| 2009/0141512 | A1 * | 6/2009 | Eberwein | 362/497 |

* cited by examiner

*Primary Examiner* — Ali Alavi
(74) *Attorney, Agent, or Firm* — Keisling & Pieper PLC; David B. Pieper

(57) ABSTRACT

There is disclosed a backlit display structure with multiple LED's arranged to transmit light into a light guide plate configured to uniformly illuminate the back of a readily replaceable translucent image sheet. The display may be incorporated with a decorative frame which also may be illuminated by the same or different LED's. The display powered by a rechargeable battery pack may also be incorporated in table top boxes for condiments, straws, napkins or other conveniences for restaurant customers where it is useful for displaying replaceable advertising or current featured menu items. In another form the guide plate does not uniformly illuminate an image sheet but only illuminates temporary marks thereon from a crayon or marker, thereby providing an illuminated blackboard.

19 Claims, 5 Drawing Sheets

BACK LIGHTED REPLACEABLE IMAGE SHEET DISPLAY APPARATUS

CROSS-REFERENCE TO RELATED APPLICATIONS

This application claims priority to and is a continuation-in-part of U.S. provisional application Ser. No. 61/132,674, filed Jun. 20, 2008.

STATEMENT REGARDING FEDERALLY SPONSORED RESEARCH OR DEVELOPMENT

Not Applicable.

REFERENCE TO A MICROFICHE APPENDIX

Not Applicable.

BACKGROUND OF THE INVENTION

1. Field of the Invention

The present invention relates to the field of back lighted displays in general. In particular, the present invention relates specifically to a simple, efficient backlit display structure with multiple LED's arranged to transmit light into a light guide plate configured to uniformly illuminate the back of a readily replaceable translucent image sheet. The display may be incorporated with a decorative frame which also may be illuminated by the same or different LED's. The display may also be incorporated in table top boxes for condiments, straws, napkins or other conveniences for restaurant customers where it is useful for displaying advertising or current menu features. Another version has a light guide which does not provide uniform back lighting but only illuminates temporary marks from a marker or crayon on the front surface of the light guide, the background remaining dark.

2. Description of the Known Art

Advertising display devices and backlighting devices for general purposes have been known as shown in the following patents: U.S. Pat. No. 3,106,314, issued to Spears, on Oct. 8, 1963; U.S. Pat. No. 4,714,983, issued to Lang, on Dec. 22, 1987; U.S. Pat. No. 5,377,084, issued to Kojima et al., on Dec. 27, 1994; U.S. Pat. No. 5,730,518, issued to Kashima et al., on Mar. 24, 1998; U.S. Pat. No. 5,842,297, issued to Tung, on Dec. 1, 1998; U.S. Pat. No. 6,367,392, issued to Moore, on Apr. 9, 2002; U.S. Pat. No. 6,447,136, issued to Liu et al., on Sep. 10, 2002; U.S. Pat. No. 6,530,164, issued to Gai, on Mar. 11, 2003; U.S. Pat. No. 6,539,656, issued to Maas et al., on Apr. 1, 2003; U.S. Pat. No. 6,561,672, issued to Lessard, on May 13, 2003; U.S. Pat. No. 6,691,443, issued to Slayden, on Feb. 17, 2004; U.S. Pat. No. 6,926,420, issued to Sung, on Aug. 9, 2005; U.S. Pat. No. 6,968,959, issued to Garvin, on Nov. 29, 2005; U.S. Pat. No. 7,024,809, issued to Poma, on Apr. 11, 2006; U.S. Pat. No. 7,026,916, issued to Alexander, on Apr. 11, 2006; U.S. Pat. No. 7,048,398, issued to Bahramian, on May 23, 2006; U.S. Pat. No. 7,063,449, issued to Ward, on Jun. 20, 2006; U.S. Pat. No. 7,131,764, issued to Hsu et al., on Nov. 7, 2006; U.S. Pat. No. 7,186,015, issued to Kimmet et al., on Mar. 6, 2007; and U.S. Pat. No. 7,226,200, issued to Tsai, on Jun. 5, 2007.

The information deemed most relevant in these patents is as follows:

U.S. Pat. No. 6,447,136 issued to Liu et al. on Sep. 10, 2002 discloses a liquid crystal display having a light guide plate for a back light system. This patent discusses light guide plates with surface irregularities in the form of annular protrusions.

U.S. Pat. No. 7,131,764 issued to Hsu et al. on Nov. 7, 2006 discloses a backlight apparatus with and edge lit guide element with concavities for directing light. FIG. 4c discloses a hexagon configuration.

U.S. Pat. No. 5,377,084 issued to Kojima et al. on Dec. 27, 1994 discloses a surface illuminating apparatus including a light guide plate, irregularly reflecting plate and back reflecting plate having incandescent light sources at each lateral end. FIGS. 7, 8 and the background discuss relevant areas of this art.

U.S. Pat. No. 6,926,420 issued to Sung on Aug. 9, 2005 discloses a backlight unit for a liquid crystal display having reflective plate with reflection dots with varying dot size and which cooperates with a smooth light guide plate.

Additional patents specifically directed to napkin holders are as follows:

U.S. Pat. No. 6,561,672 issued to Lessard on May 13, 2003 discloses an illuminated holder for finding miscellaneous objects in the dark. The illumination is on the sides of the unit and does not teach an backlit illuminated advertisement section.

U.S. Pat. No. 3,106,314 issued to Spears on Oct. 8, 1963 discloses an advertising napkin holder. The advertisement is insertable and removable from flanges on the sides of the unit, but no illuminated advertisement is provided.

The other patents disclose additional illumination and display elements of other forms.

SUMMARY OF THE INVENTION

The present invention provides a simple, efficient backlit display structure with multiple LED's arranged to transmit light into a light guide plate configured to uniformly illuminate the back of a readily replaceable translucent image sheet. The display may be incorporated with a decorative frame which also may be illuminated by the same or different LED's. The display may also be incorporated in table top boxes for condiments, straws, napkins or other conveniences for restaurant customers where it is useful for displaying advertising or current menu features.

The invention provides that the use of high intensity light emitting diodes allows for a battery power or other low voltage system that reduces the risk of shock while providing sufficient light to uniformly illuminate the back of a replaceable advertising image sheet. The LED light sources can be powered for many hours from a rechargeable battery with overnight recharging as convenient. The low current drain also permits the use of disposable batteries in place of rechargeable batteries if desired. These high intensity LEDs work well with translucent image sheets that do not have high transparency. The light guide plate has light directing surface irregularities sufficiently spaced from the position of the image sheet to produce substantially uniform backlighting without interposition of a diffuser plate thereby enhancing the effectiveness and efficiency of the apparatus.

An important feature is the accessibility to the image sheet for replacement by separating the front window and the backlighting apparatus. This feature is also present in the tabletop units that have a rechargeable batter pack in the base thereof. Another version of the display dispenses with the backlit image sheet and the smooth surfaced light guide only illuminates marks from a marker or crayon on the front surface.

These and other objects and advantages of the present invention, along with features of novelty appurtenant thereto, will appear or become apparent by reviewing the following detailed description of the invention.

BRIEF DESCRIPTION OF THE SEVERAL VIEWS OF THE DRAWINGS

In the following drawings, which form a part of the specification and which are to be construed in conjunction therewith, and in which like reference numerals have been employed throughout wherever possible to indicate like parts in the various views.

DETAILED DESCRIPTION OF THE INVENTION

Figure 1:
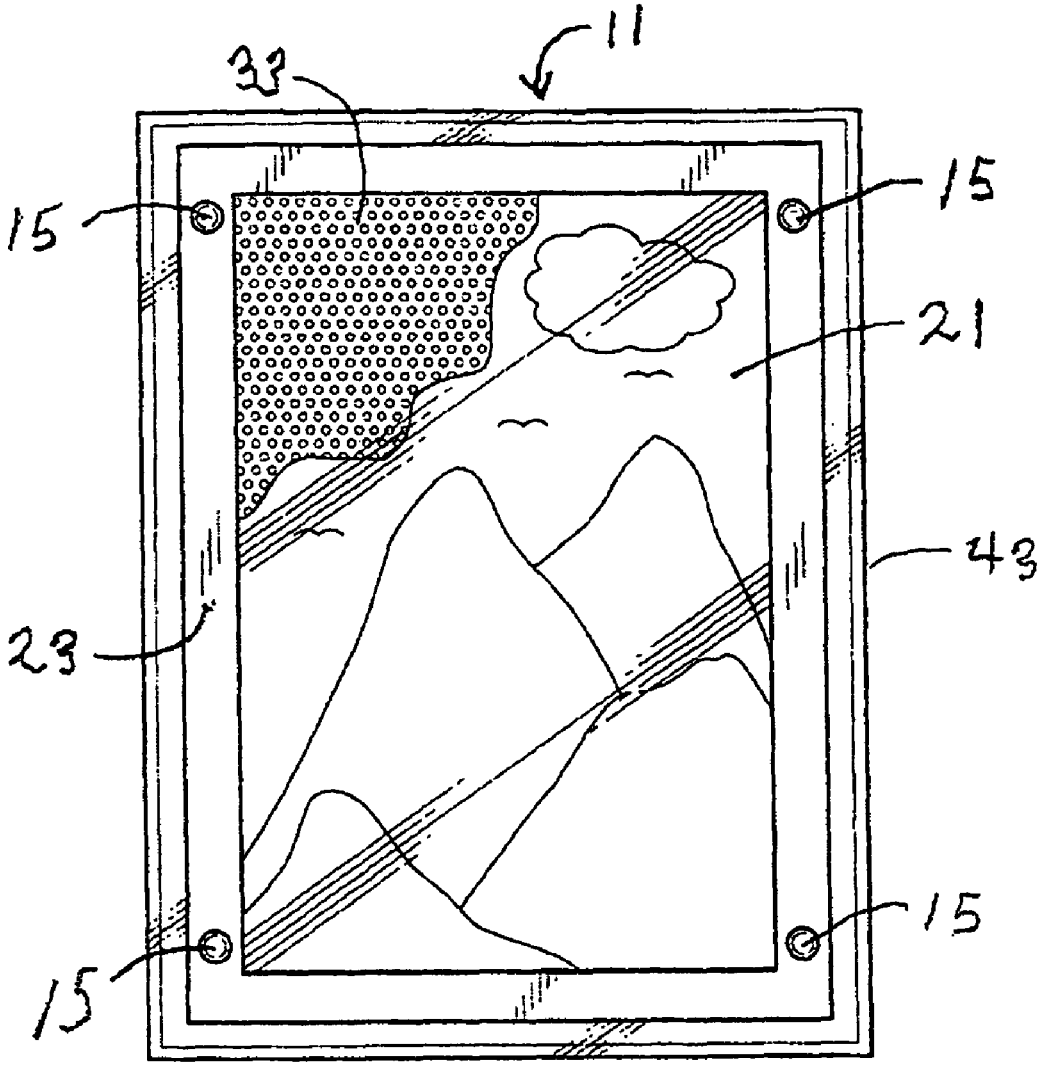
FIG. 1 is a front view of a display structure according to the present invention.
Figure 2:
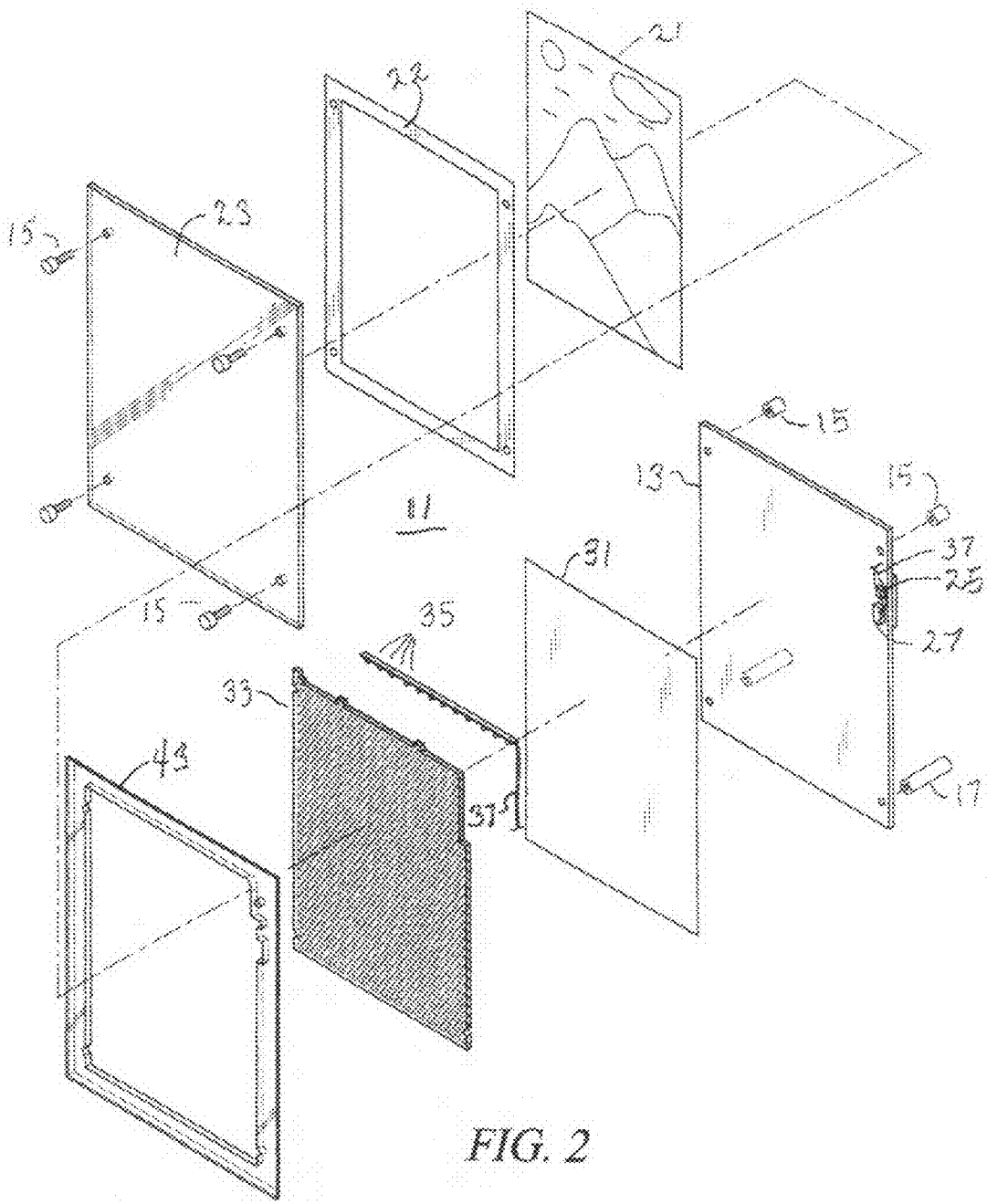
FIG. 2 is an exploded view showing the elements of the display structure of FIG. 1.
Figure 3:
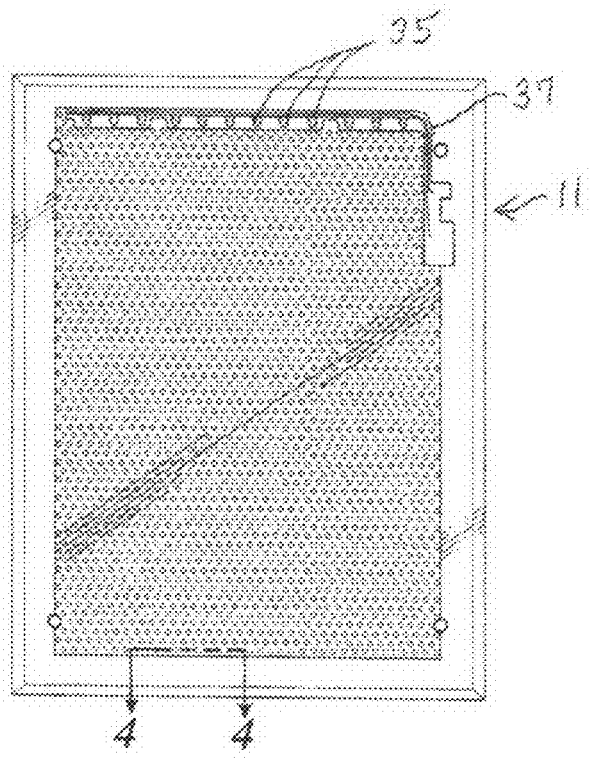
FIG. 3 is a back view showing the back of the light guide shown in FIG. 2.
Figure 5:
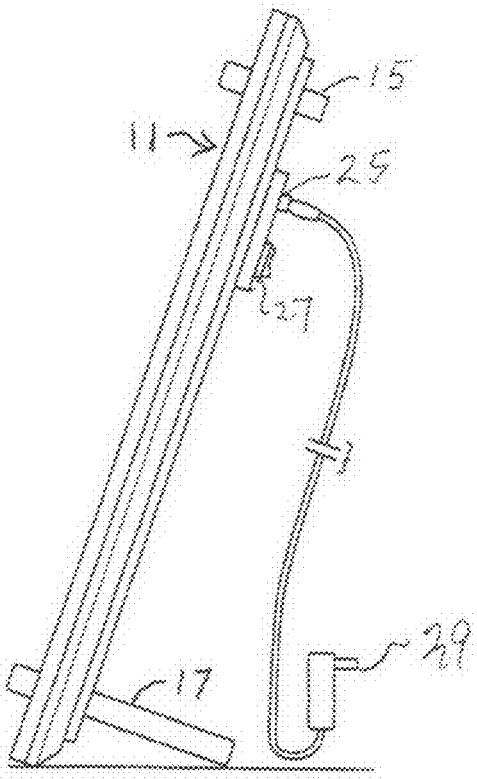
FIG. 5 is a right side view of the display structure of FIGS. 1-4.

FIGS. 1 through 5 show a single-display embodiment of the invention which is enhanced by an illuminated frame and is suitable for display of advertising material or as a picture frame for personal use. As seen in FIGS. 1-3 display structure 11 has a frame 13 to which other components are secured including fasteners 15 and extended fasteners 17. This optional fastener arrangement provides means for holding the display structure vertically in either a portrait or landscape orientation, as shown in FIG. 5. The female portions of the fasteners 15 on the back of the display structure 11 may optionally be provided with internally threaded openings 16 to use for securing multiple displays on a display board for advertising purposes, for example. In this embodiment the fasteners 15 are readily manipulated from the front of the display to access and replace the image sheet 21 behind window 23 as will later be described.

Secured on the back of frame 13 are electrical components DC input 25 and control switch 27. DC input 25 accepts a plug from a conventional AC-DC converter 29 (of 3 volts for example) providing power for the display. This illustrated embodiment is not provided with a battery compartment to allow cordless operation, but such could be added if desired.

Figure 4:
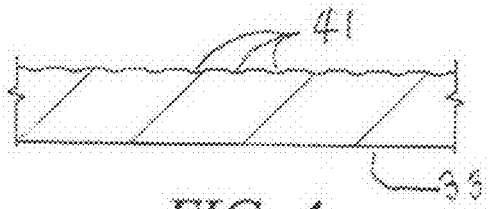
FIG. 4 is a fragmentary enlarged sectional view along line 4-4 in FIG. 3.

The internal components of display structure 11 are best shown in FIGS. 2 and 3. In front of the frame 13 is a light guide plate 33 backed by a white reflector sheet 31. Mounted on the edge of light guide plate 33 are a plurality of LED's 35 connected by an electrical circuit 37 to input 25 and switch 27. The LED's 35 are typically 10 to 15 in number spaced 5 to 15 millimeters apart. Although only one edge of light guide plate is illuminated by LED's in the illustrated embodiment, the LED' could be placed on two or more edges. The light guide plate uses a know expedient to direct light forward in a uniform manner in the form of a multiplicity of indentations 41, detailed (not to scale) in FIGS. 3 and 4 showing the back of light guide plate 33. They are from 0.5 to 1.5 millimeters in dimension and spaced in a hexagonal array about 1 to 3 millimeters apart. Other of many known light guide configurations could be employed rather than that illustrated; some such configurations are described in the reference patents cited above.

Surrounding the light guide plate 33 is an outer decorative frame 43 which is of greater dimensions than the window 23 so that it forms the outer border of the display. In this embodiment decorative frame 43 is of transparent material in contact with the edges of light guide plate 33 so that it is rendered luminous by light from LED's 35. This feature and the outer decorative frame itself is optional and not required in other embodiments.

The window 23 is backed by a mask 22 to conceal LED's 35 and other working parts and is secured at the front of display structure 11 by readily removable fasters 15 and 17. Other components are fastened together in a conventional manner by screws or the like (not shown). Window 23 may have any opaque border other than mask 22 serving to conceal the LED's 35 and edges of the light guide plate 33.

A selected translucent image sheet 21 is placed between light guide plate 33 and window 23 (as by taping it in place on the back of window 23). The conventional AC-DC converter 29 used to power (or recharge) the display is shown in FIG. 5.

The major components described above are preferably formed of plastic, especially the transparent window and light guide plate, while fasteners and other parts may be of metal or plastic or combinations thereof. Other materials such as glass, wood, fiberboard or metal could be used for some of the components, if desired.

An important aspect of the invention is the manner in which the light from the LED"s through the light guide plate substantially uniformly illuminates the image sheet on the back of the window without the necessity for an intervening diffuser screen. The path from the back of the light guide plate 33 to the translucent image sheet 21 is completely transparent so that there is no loss of light intensity from a diffuser screen. This is facilitated by the fact that the thickness of the light guide plate 33 is significantly greater than the dimensions of the indentations 41 and at least as great or greater than the spacing between them. The translucent image sheet being so uniformly illuminated from the back, there is no perception of the LED pattern.

The advantage of ready changeability for the image sheets is provided by the separate attachment of window 21 with fasteners 15 and 17, particularly in this embodiment where they are readily accessible from the front. Other embodiments provide accessibility in different manners.

A variation of the back-lit display structure allows it to be used as a "blackboard" which may be written on by markers or crayons which marks represent the translucent display, rather than a separate translucent image sheet. Such a back-lit blackboard is useful for advertising menu items and has many other uses.

The blackboard version has significant differences, notably the absence of surface irregularities so both surfaces of the light guide are smooth and light is not directed forward from the light guide in the absence of marking material on the front of the light guide plate. Accordingly the backlit display structure 11 previously described can be changed to make a backlit blackboard by the minimal modifications of changing the reflector 31 to a black surfaced sheet and eliminating all light guide plate 33 surface irregularities such as indentations 41 and any translucent image sheet 21.

Other elements such as window 23 could be retained but would be optional. Many markers or crayons will leave a mark in contact with face of the light guide that defeats the total internal reflection crucial to guiding light in the plate thereby allowing the mark to be brightly illuminated by light escaping from the guide. Alternatively a transparent sheet my be provided in place of the translucent image sheet 21 so that marks on the sheet in intimate contact with the light guide would be illuminated in a similar same manner. With the above minor changes FIG. 2 would illustrates the back-lit blackboard display structure described above and claimed hereinafter.

Figure 6:
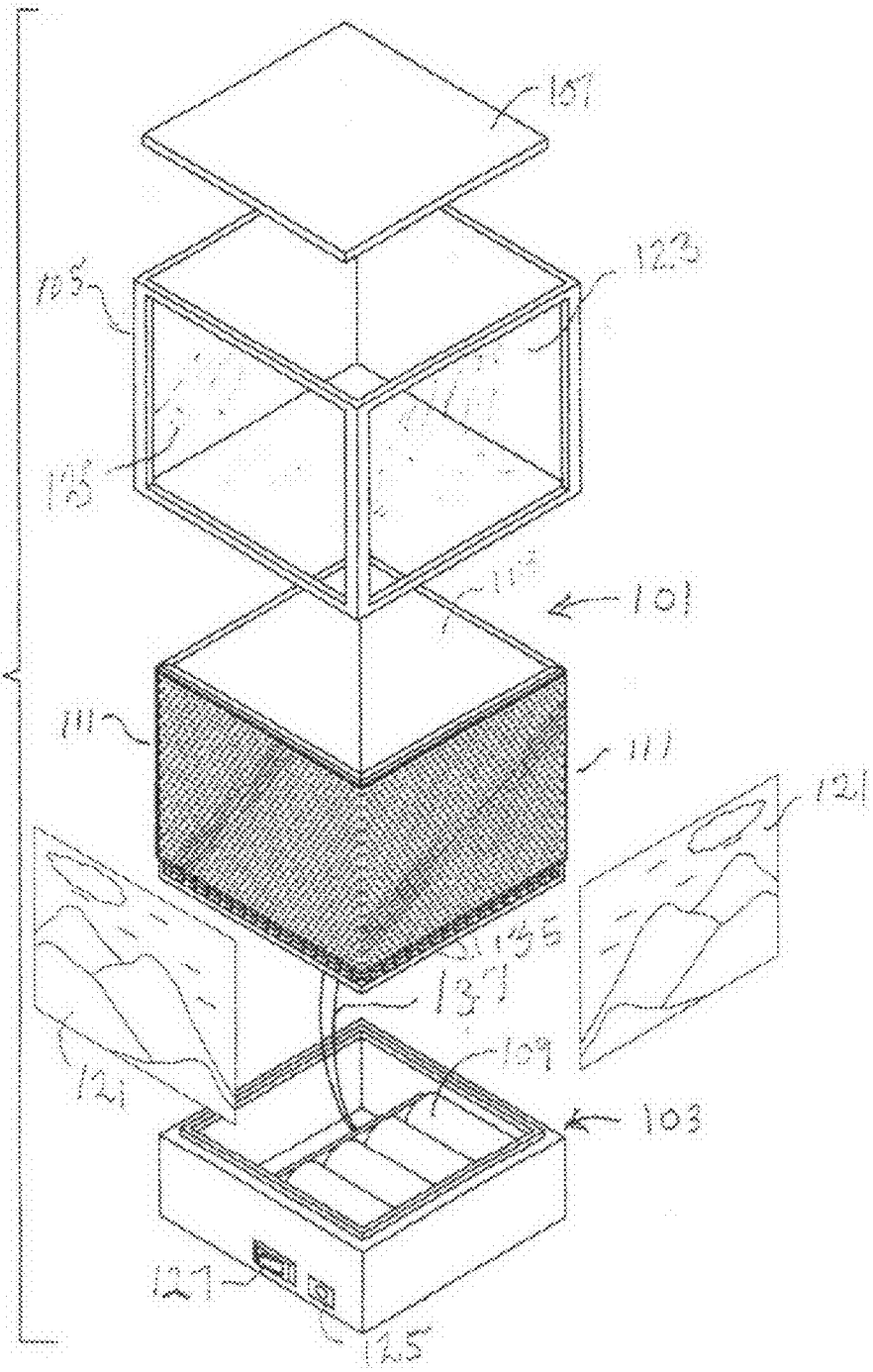
FIG. 6 is an exploded view of another embodiment of the invention with display structures incorporated in a table top box.
Figure 7:
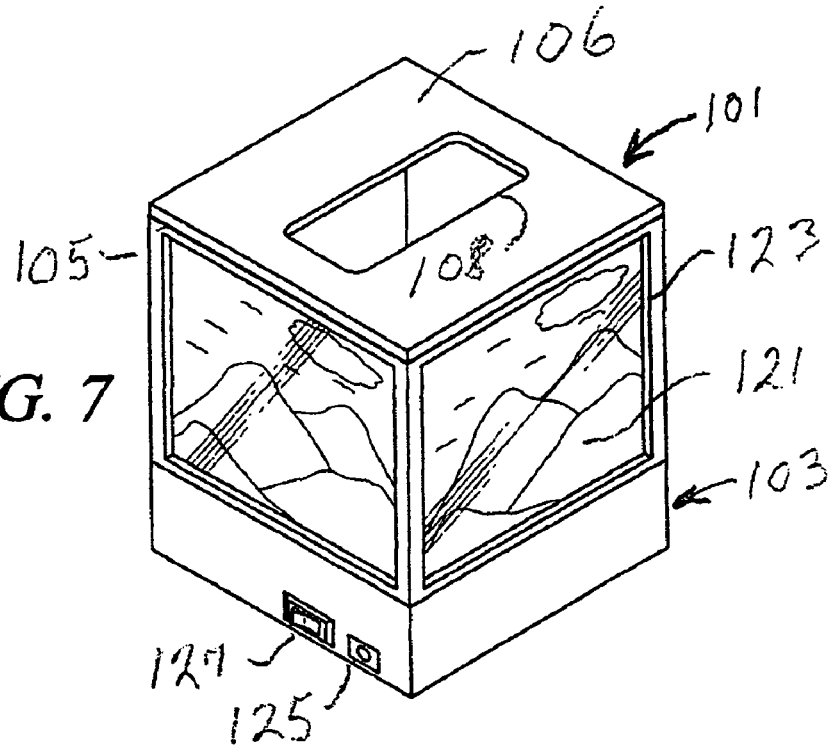
FIG. 7 is a perspective view of a variation of the FIG. 6 embodiment adapted for use as a napkin dispenser.
Figure 8:
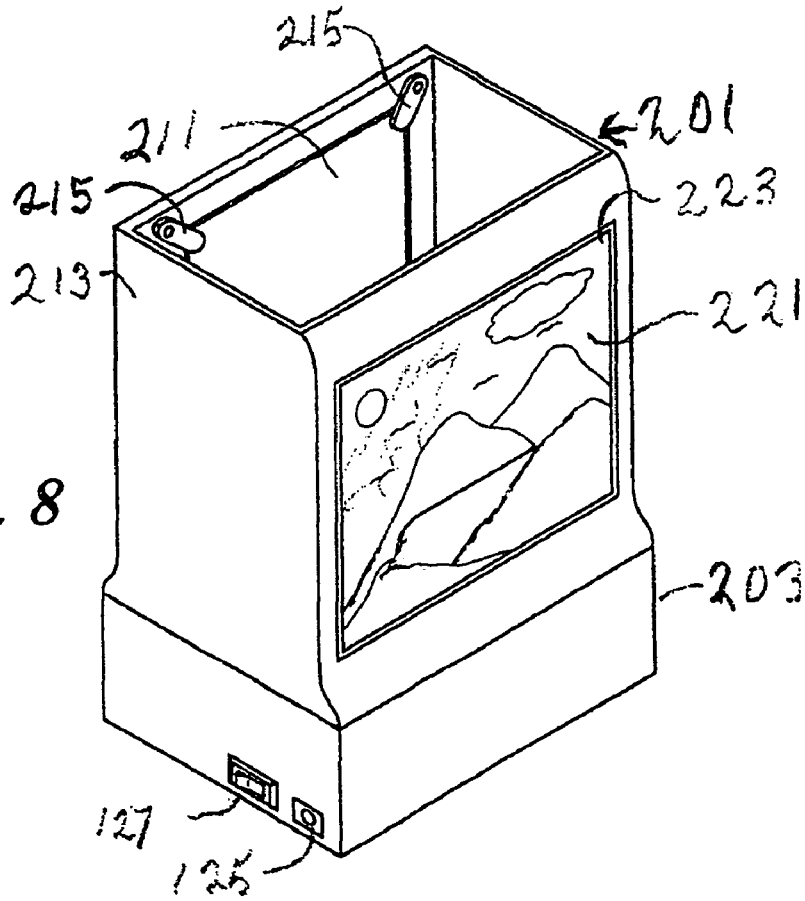
FIG. 8 is a perspective view of another embodiment of the invention providing a square box with front and back backlit displays.

The basic elements of the display structure described above can be usefully employed in other embodiments as exemplified by the embodiments illustrated in FIGS. 6-8 which show restaurant tabletop customer convenience items, in the form of a napkin dispenser, for example. Such tabletop configurations could in larger versions be provided with wheels and be freestanding floor units. In FIG. 6 the box 101 and its base 103 provide a portable container having two displays 111 each with basic elements corresponding to those of the display structure 11, and such correspondence will be assumed herein unless otherwise indicated. Although two displays 111 are shown for box 101, up to four displays could be provided in similar manner.

The interior walls 113 serve as the frame to which other components of displays 111 are secured. A case 105 slides over and surrounds box 113 and displays 111. The portions of case in front of displays 111 have windows 123. Case 105 when in the position shown in FIG. 7 causes windows 123 to be positioned so that the illuminating portion of display 111 is revealed. Case 115 is held in position on box 101 by conventional releasable fasteners (not shown) A display sheet 121 similar to display sheet 21 is secured between each display 111 and the corresponding window 123. Case 105 is lifted off the interior walls of box 113 and light guides 111 to access and replace an image sheet 121 behind window 123. A solid top 107 may be provided for case 105 if desired.

Secured on the base 103 are electrical components DC input 125 and control switch 127. DC input 125 accepts a plug from a conventional AC-DC converter (of 3 volts for example) providing power for the display and for battery compartment 109 within base 103 thereby to allow cordless operation if desired. An electrical circuit 137 includes a connection form battery compartment 109 and/or switch 127 to LED's 135 at the bottoms of displays 111. The electrical circuit 137 and switch 127 may in conventional manner have operational modes for on, off and recharge. It will be noted that since LED's 135 are at the bottom of light guides of displays 111, they could alternatively be mounted at top edges of base 103 simplifying the electrical connections to the LED's.

FIG. 7 shows the same structure as in the FIG. 6 exploded view except that top 107 has been replaced by cover 106 having an opening 108 so that the unit of FIG. 7 functions as a napkin dispenser. In both FIG. 6 and FIG. 7 the base is preferably detachably secured to the structure by releasable fasteners, not shown. This facilitates recharging the batteries and use of extra bases that can be recharged while the displays are in active use.

FIG. 8 shows another embodiment of the invention which is generally similar to that of FIGS. 6 and 7 except that unit 201 has a rectangular shape rather than the square shape of unit 101, and the manner of separating the display light guide plate from the window to replace image sheets differs from that of other units. The box may of course take any shape with three four or more sides of any proportion. Any or all sides of the box may serve as a location for a backlit display as may be desired for the particular use and environment. The unit 201 of FIG. 8 is adapted to hold one or more boxes of straws, stirrers, table ware or he like accessible to restaurant customers or servers.

The unit 201 includes a box 213 having windows 223. The backlit display structure 211 is similar to that of FIG. 2 but it is secured against window 223 from the inside of box 213 and held in place by releasable fasters such as rotatable tabs 215. Except for a difference in shape, base 203 is similar to base 103 of other embodiment with battery compartment connected by an electrical to switch 127 and DC input 125 and to the LED's, not shown. Preferably base 203 is likewise separable from box 213 although this is not necessary to separate display structures 211 from windows 223 to access image sheets 221.

Note that due to the compatibility of the embodiments described herein, features of one can often be transferred to others within the scope of the invention. Also features of one may be substituted for a comparable feature of another.

A variation of the back-lit display structure allows it to be used as a "blackboard" which may be written on by markers or crayons which marks represent the translucent display, rather than a separate translucent image sheet such a back-lit blackboard is useful for advertising menu items and has many other uses.

The blackboard version has significant differences, notably the absence of surface irregularities so both surfaces of the light guide are smooth and light is not directed forward from the light guide in the absence of marking material on the front of the light guide plate. Accordingly the backlit display structure 11 previously described can be changed to make a backlit blackboard by the minimal modifications of changing the reflector 31 to a black surfaced sheet and eliminating all light guide plate 33 surface irregularities such as indentations 41 and any translucent image sheet 21. Other elements such as window 23 could be retained but would be optional. Many markers or crayons will leave a mark in contact with face of the light guide that defeats the total internal reflection crucial to guiding light in the plate thereby allowing the mark to be brightly illuminated by light escaping from the guide. Alternatively a transparent sheet my be provided in place of the translucent image sheet 21 so that marks on the sheet in contact with the light guide would be illuminated in the same manner. With the above minor changes FIG. 2 illustrates the back-lit blackboard display structure disclosed above and claimed hereinafter.

In addition to those described above, other modifications and variations of the disclosed apparatus will be apparent to those skilled in the art and should be considered to be within the scope of the invention.

What is claimed is:

1. A back-lit display structure comprising:

a reflective surface, a light guide plate which receives light at an edge and guides it laterally through said light guide plate, said light guide plate having a multiplicity of light directing surface irregularities causing light to be directed transversely to said light guide plate, said surface irregularities being dimensioned and spaced apart in a manner to minimize non-uniformity in light intensity from different areas of said light guide plate, a plurality of light emitting diodes arranged to transmit light into at least one edge of said light guide plate, a transparent flat window on the front of said structure, the back of said window providing a fixed location for an image sheet, the window being placed at a space from said surface irregularities greater than the maximal distance between adjacent ones of said surface irregularities, paths through said space being transparent, a frame element holding the components of said structure in place, and removable fasteners for said window facilitating separation thereof to access said image sheet.

2. A display structure as recited in claim 1 wherein said removable fasteners are accessible from in front of said window.

3. A display structure as recited in claim 1 further including a decorative frame of transparent material located to receive light from said light guide plate and shaped to direct a light pattern from around the front of said display structure.

4. A display structure as recited in claim 1 further including at least two fastener extensions extending from the rear of said structure configured to support said structure in a free standing position or facilitate mounting in a stand-off mode on a vertical wall.

5. A display structure as recited in claim 1 wherein said surface irregularities are indentations in the rear surface of said light guide plate from about one-tenth millimeter to about two millimeters in width with spaces between indentations not substantially greater than their width.

6. A display structure as recited in claim 1 wherein said window is larger than said light guide plate and has opaque portions serving to conceal the edges of said light guide plate and said light emitting diodes.

7. A back-lit display structure comprising:

one or more plates on the back of said structure providing a reflective surface facing forward, a light guide plate which receives light at an edge and guides it laterally through said light guide plate, said light guide plate having front and back surfaces and associated therewith a planar arrangement of a multiplicity of light directing indentations causing light to be directed transversely to said light guide plate front and back surfaces, said indentations being dimensioned and spaced apart in a manner to minimized non-uniformity in light intensity from different areas of said light guide plate, a plurality of light emitting diodes arranged to transmit light into at least one edge of said light guide plate, a transparent flat window on the front of said structure, the back of said window providing a fixed location for a translucent image sheet, the window being placed at a space from the plane of said indentations greater than the maximal distance between adjacent ones of said indentations, with all media in said space being transparent, a frame holding the components of said structure in place, and removable fasteners accessible to separate said window for access to said translucent image sheet.

8. A display structure as recited in claim 7 wherein said removable fasteners are accessible from in front of said window.

9. A display structure as recited in claim 7 further including a decorative frame of transparent material located to receive light from said light guide plate and shaped to direct a light pattern from around the front of said display structure.

10. A display structure as recited in claim 7 further including at least two fastener extensions extending from the rear of said structure configured to support said structure in a free standing position or facilitate mounting in a stand-off mode on a vertical wall.

11. A tabletop display unit having at least one back-lit display comprising:

a box [for convenience items] having a base, at least three sides enclosing a storage space, said base having a detachable portion with a rechargeable battery pack therein, said box having in at least one of said sides a backlit display structure including:

a reflective surface at the back thereof, a light guide plate which receives light at an edge and guides it laterally through said light guide plate, said light guide plate having a multiplicity of light directing surface irregularities causing light to be directed transversely to said light guide plate, said surface irregularities being dimensioned and spaced apart in a manner to minimize non-uniformity in light intensity from different areas of said light guide plate, a plurality of light emitting diodes arranged to transmit light into at least one edge of said light guide plate, an electrical input connector, an electrical circuit connecting said connector, said light emitting diodes and said battery pack, a transparent flat window on the front of said display structure, the back of said window providing a fixed location for an image sheet, said window being releaseabley secured, thereby facilitating access to said image sheet for replacement thereof.

12. A unit as recited in claim 11 wherein said surface irregularities are indentations in the rear surface of said light guide plate from about one-tenth millimeter to about two millimeters in width with spaces between indentations not substantially greater than their width.

13. A unit as recited in claim 11 wherein said box has four sides and there is a said display structure in each of two opposite sides of said box.

14. A unit as recited in claim 12 wherein said box has four sides and there is a said display structure in each of two opposite sides of said box.

15. A back-lit display structure comprising:

a light guide plate which receives light at an edge and guides it laterally through said light guide plate, said light guide plate being transparent and having smooth front and back surfaces, a plurality of light emitting diodes arranged to transmit light into at least one edge between said front and back surfaces of said light guide plate, a transparent window on the front of said structure, the back of said window being adjacent said front surface of said light guide plate, a frame holding the components of said structure in place and concealing said light emitting diodes, and removable fasteners accessible to separate said window for access to a surface for placing or replacing an image produced by translucent marks from a marker or a crayon on the surface.

16. A display structure as recited in claim 15 wherein said removable fasteners are accessible from in front of said window.

17. A display structure as recited in claim 15 wherein said window includes more than one layer of transparent material.

18. A back-lit display structure comprising:

a light guide plate which receives light at an edge and guides it laterally through said light guide plate, said light guide plate being transparent and having smooth front and back surfaces, a plurality of light emitting diodes arranged to transmit light into at least one edge between said front and back surfaces of said light guide plate, a back for said light guide plate having a non-reflecting surface, a window on the front of said structure, said window exposing to view a portion of said front surface of said light guide plate, a frame holding the components of said structure in place, and fasteners through said frame with extensions adapted to support said structure in a desired viewing position.

19. A back-lit display structure as recited in claim 18 wherein said front surface of said light guide plate will accept translucent marks from markers or crayons and cause light to escape through said surface to illuminate said marks while unmarked portions of said surface are not illuminated.

* * * * *